US006089928A

United States Patent [19]

Miwa et al.

[11] Patent Number: 6,089,928

[45] Date of Patent: Jul. 18, 2000

[54] ELECTRIC TERMINAL

[75] Inventors: Takeya Miwa; Masaya Yamamoto, both of Shizuoka, Japan

[73] Assignee: Yazaki Corporation, Tokyo, Japan

[21] Appl. No.: 09/275,402

[22] Filed: Mar. 24, 1999

[30] Foreign Application Priority Data

Mar. 27, 1998 [JP] Japan ..... 10-082081

[51] Int. Cl.[7] ..... H01R 13/514

[52] U.S. Cl. ..... 439/752; 439/595

[58] Field of Search ..... 439/752, 595, 439/752.5

[56] References Cited

U.S. PATENT DOCUMENTS 5,478,263 12/1995 Kato ..... 439/752

*Primary Examiner*—Gary F. Paumen

*Attorney, Agent, or Firm*—Armstrong, Westerman, Hattori, McLeland & Naughton

[57] ABSTRACT

In combination, an electric terminal with an electric contact portion, the contact portion having a hollow square shape and comprising a ceiling wall with a shoulder formed at an end thereof on a side opposite a side where a mating terminal is fitted, a side wall, and a stabilizer including an extension plate extending in a height direction from the side wall and bent back on a side of the ceiling wall to provide a double layered plate; a connector housing with a terminal receiving cavity formed therein; and a terminal locking device mountable in a preliminary locked and full locked positions on the connector housing. The terminal locking device is movable from the preliminary locked position to the full locked position only when the electric terminal has been fully inserted into the terminal receiving cavity.

4 Claims, 5 Drawing Sheets

ELECTRIC TERMINAL

BACKGROUND OF THE INVENTION

1. Field of the Invention

This invention relates to an electric terminal.

2. Description of the Related Art

Conventionally, in order to lock a terminal in a terminal receiving cavity of a connector housing, as shown in FIG. 8, a locking hole 63 of a terminal 62 is engaged in by a locking lance 61 provided in a connector housing 60, or as shown in FIG. 9, a locking piece 64 projecting from the terminal 62 is engaged with by a locking step 66 inside a terminal receiving cavity 65. In either case, with a terminal locking device 67 in a preliminary locked position on the connector housing 60, the terminal 62 is inserted to be locked in the manner mentioned above in the terminal receiving cavity 65. The terminal locking device 67 is then moved to the full locked position on the connector housing 60, which, when can be done, proves that the terminal 62 has been fully inserted into the terminal receiving cavity 65. When in the fully inserted position, the terminal 62 is electrically connectable with a mating terminal (not shown).

In the former case, however, the connector housing 60 becomes large in size as much as the locking lance 61 is provided in the connector housing 60, and in the latter case, although the connector housing 60 can be downsized, there is a drawback that the locking piece 64 projecting from the terminal 62 may get deformed and damaged, adversely affecting the arrangement for detecting the position of the inserted terminal 62.

SUMMARY OF THE INVENTION

This invention has been accomplished to overcome the above drawbacks and an object of this invention is to provide an electric terminal the position of which, when inserted into a terminal receiving cavity, can be reliably detected.

In order to attain the object, according to an aspect of this invention, there is provided, in combination, an electric terminal with an electric contact portion, the contact portion having a hollow square shape and comprising a ceiling wall with a shoulder formed at an end thereof on a side opposite a side where a mating terminal is fitted, a side wall, and a stabilizer, the stabilizer including an extension plate extending in a height direction from the side wall and bent back on a side of the ceiling wall to provide a double layered plate; a connector housing with a terminal receiving cavity formed therein; and a terminal locking device mountable in a preliminary locked and full locked positions on the connector housing, the terminal locking device including a resilient locking arm and a side wall, the side wall having a cutout corresponding to the stabilizer of the electric terminal, wherein when the terminal locking device is mounted in the preliminary locked position on the connector housing, the electric terminal is insertable into the terminal receiving cavity to have the shoulder engaged by the resilient locking arm, and when the terminal locking device is moved from the preliminary locked position to the full locked position on the connector housing, the stabilizer, while maintaining the shoulder engaged by the resilient locking arm, engages in the cutout, and wherein the terminal locking device is movable from the preliminary locked position to the full locked position only when the electric terminal has been fully inserted into the terminal receiving cavity.

Advantageously, the stabilizer further comprises a reinforcement plate extending from an end of the bent back extension plate and located on the ceiling wall of the contact portion.

Preferably, the stabilizer is located at an end of the side wall on the side opposite the side where the mating terminal is fitted, and the reinforcement plate is located on the end of the ceiling wall.

According to another aspect of this invention, there is provided an electric terminal with an electric contact portion, the contact portion having a hollow square shape and comprising: a ceiling wall with a shoulder formed at an end thereof on a side opposite a side where a mating terminal is fitted; a side wall; and a stabilizer, the stabilizer including an extension plate extending in a height direction from the side wall and bent back on a side of the ceiling wall to provide a double layered plate.

Advantageously, the stabilizer further comprises a reinforcement plate extending from an end of the bent back extension plate and located on the ceiling wall of the contact portion.

Preferably, the stabilizer is located at an end of the side wall on the side opposite the side where the mating terminal is fitted, and the reinforcement plate is located on the end of the ceiling wall.

The above and other objects, features and advantages of this invention will become apparent from the following description and the appended claims, taken in conjunction with the accompanying drawings.

DESCRIPTION OF THE PREFERRED EMBODIMENT

An embodiment of this invention will now be described with reference to the attached drawings.

FIGS. 1 to 7 show one embodiment of an electric terminal according to this invention. In the present embodiment, description is made of a case where this invention is applied to a female-type terminal, but is also applicable to a male-type terminal.

Figure 1:
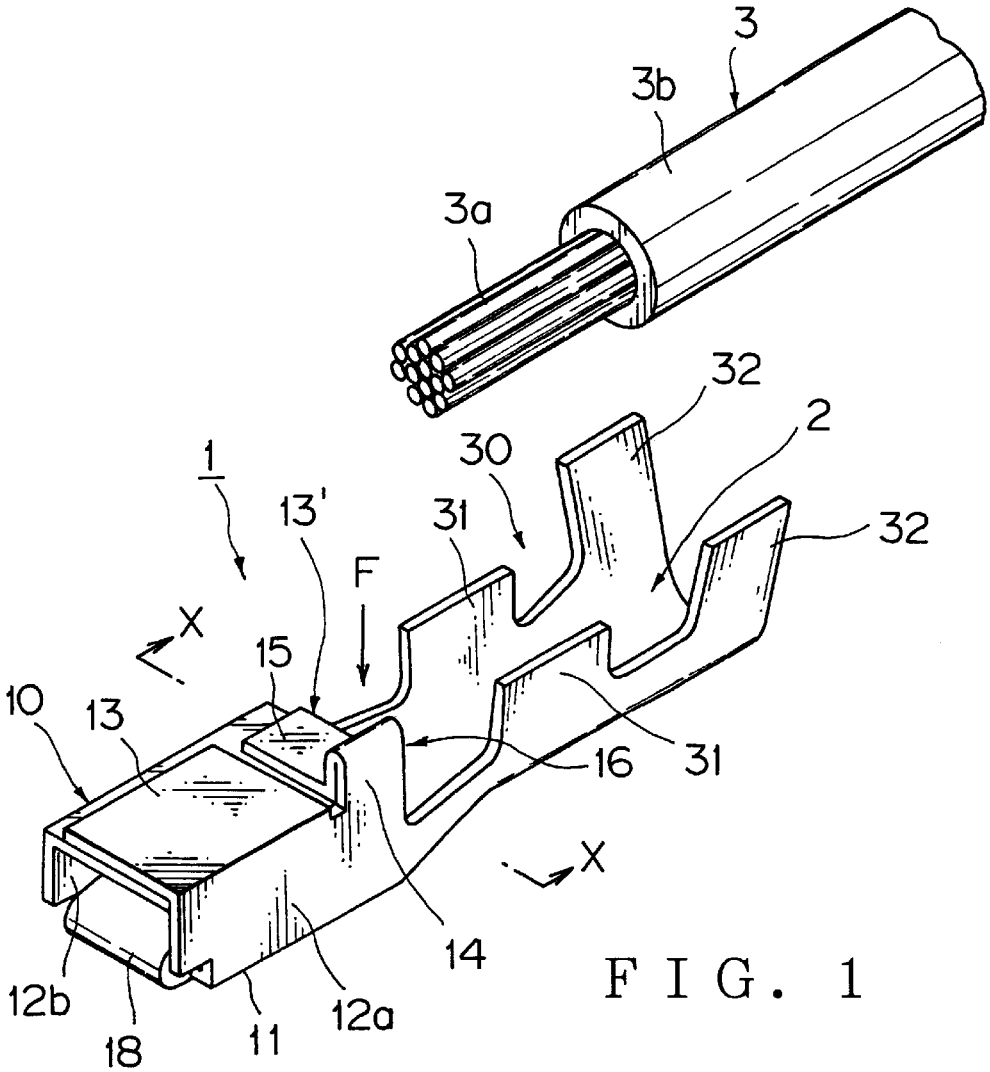
FIG. 1 is a perspective view of a terminal according to one embodiment of this invention.

In FIG. 1, a terminal 1 is formed by bending a conductive terminal blank 2 and has at one end portion a hollow square electric contact section 10 and at the other end portion a wire connecting section 30.

Figure 3:
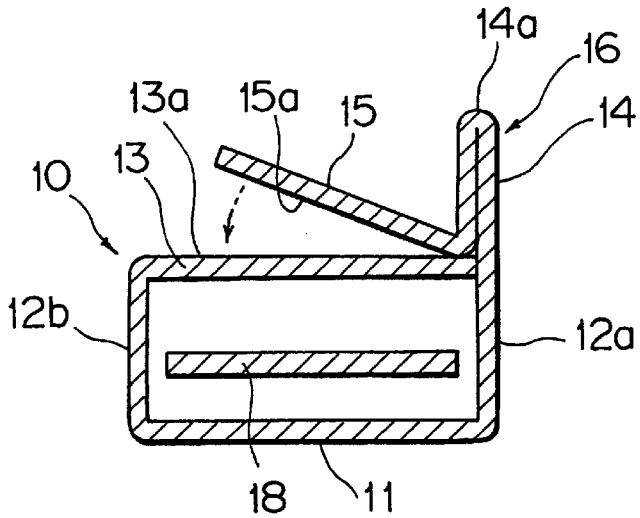
FIG. 3 is a sectional view similar to FIG. 2, showing an extension plate being bent.
Figure 2:
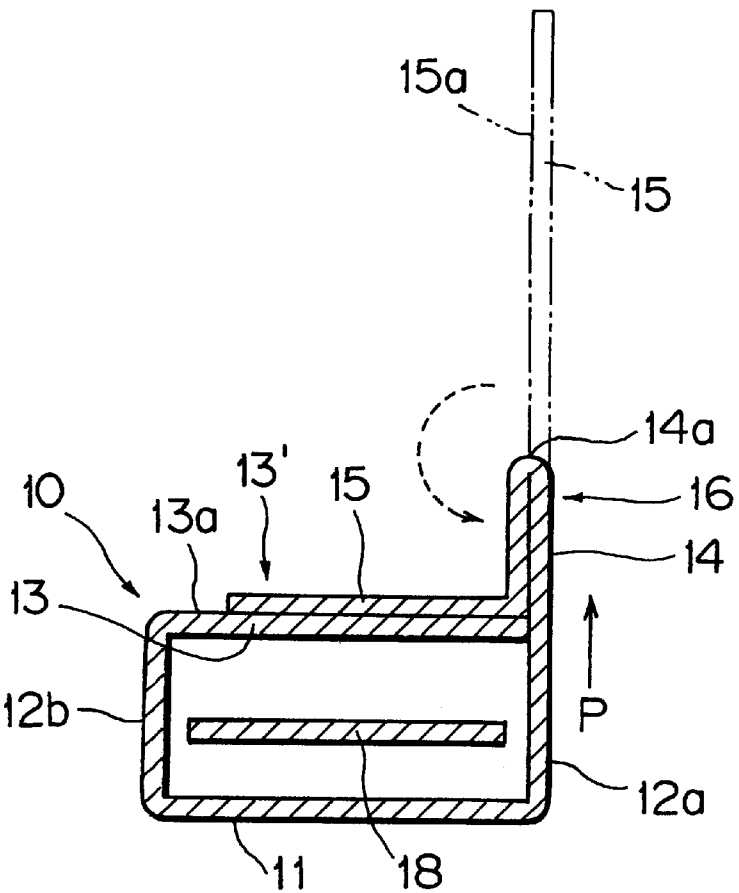
FIG. 2 is a sectional view taken along the line X—X of FIG. 1.

The electric contact section 10 consists of a bottom wall 11, side walls 12*a*, 12*b* upstanding at opposite lateral sides of the bottom wall 11, a ceiling wall 13 provided between upper portions of the side walls 12*a*, 12*b*, and a stabilizer 16 located at an end (rear end) of the side wall 12*a* opposite its end (front end) on the side where a mating terminal is fitted. The stabilizer 16, as shown in FIGS. 1 to 3, includes an extension plate 14 which extends upwardly from an upper end of the side wall 12*a* as indicated by an arrow P, i.e., in the same direction as the side wall 12*a* upstands. The extension plate 14 is bent back inwardly at a height to be juxtaposed with itself and provide a double layered plate which constitutes the stabilizer 16 and is further extended at its end by a horizontal reinforcement plate 15 laid on the ceiling wall 13 to reinforce the latter and provide a double ceiling wall 13' near its rear end. Incidentally, it is also possible to provide such stabilizers 16 on both side walls 12*a*, 12*b*. Denoted 18 is a resilient contact piece provided inside the electric contact section 10 for electric contact with a mating terminal.

With the structure as mentioned above, the stabilizer 16 will not be bent or deformed even under an external force acting from the direction F. The double ceiling wall 13', which has a thickness twice that of the ceiling wall 13, serves to lock the double ceiling wall 13' in engagement with a later-described resilient locking arm 49 with a force stronger than conventionally obtained.

The electric connecting section 30 includes a pair of upstanding conductor holding pieces 31, 31 which are crimped on the conductor 3*a* of the wire 3 and a pair of upstanding cover holding pieces 32, 32 which are crimped on the insulating cover 3*b* of the wire 3.

Figure 4:
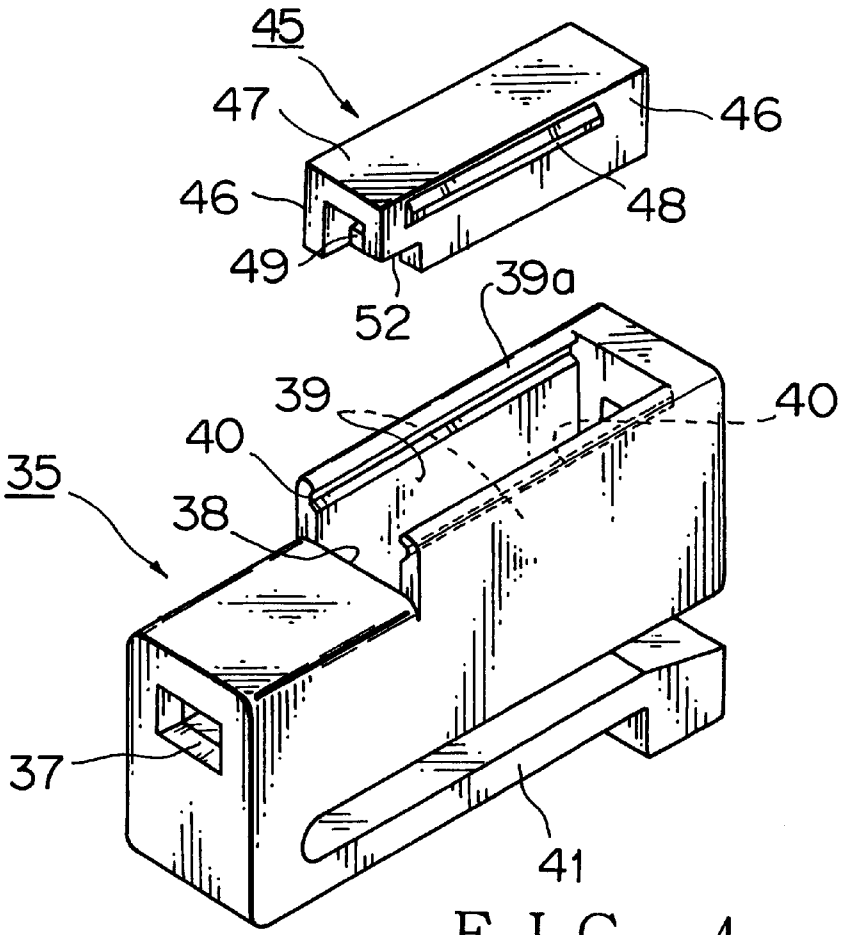
FIG. 4 is a perspective view of a connector housing into which the terminal of FIG. 1 is inserted and a terminal locking device which enables detection of the position of the terminal inserted into the connector housing.

As shown in FIG. 4, the connector housing 35, which is formed of synthetic resin, has a terminal receiving cavity 37 for receipt therein of the terminal 1 (FIG. 1), and a locking device mount opening 38 which opens upwardly. The mount opening 38 is in communication with the terminal receiving cavity 37 and is defined at its lateral sides by opposite side walls 39, 39 and at its rear side by a rear wall 47', the opposite side walls 39, 39 being provided on their inner surfaces near the upper end with locking grooves 40 which extend transversely to a mounting or insertion direction of the terminal locking device 45 into the connector housing 35.

The terminal locking device 45, which serves to detect whether the terminal 1 (FIG. 1) inserted into the terminal receiving cavity 37 is in a fully-inserted position, is insertedly mounted on the connector housing 35 through the locking device mount opening 38. At a lower portion of the connector housing 35 is provided a locking arm 41 for a mating connector housing (not shown).

The terminal locking device 45 has a box-like shape with a bottom wall omitted so as to open downwardly, and includes a pair of parallel side walls 46, 46, a rear wall 47' (FIG. 5) provided between the side walls 46, 46 at the rear end, and a ceiling wall 47 provided on top of these walls. The terminal locking device 45 thus has a U-shaped cross section. On their outer surfaces, the side walls 46, 46 have respective locking projections 48 for engagement in the locking grooves 40, the locking projections 48 extending in a longitudinal direction of the side walls 46, 46. The resilient locking arm 49 depends at its base from the under-side of the ceiling wall 47 and extends forwardly, the resilient locking arm 49 having a locking claw 50 at its free end. One of the side walls 46, 46 is provided at its front, lower end with a cutout 52 for engagement therein of the stabilizer 16. The terminal locking device 45 has on its rear wall 47' a locking projection 51.

The process of detecting whether a terminal 1 has been fully inserted into the terminal receiving cavity 37 will now be described with reference to FIGS. 5 to 7.

Figure 5:
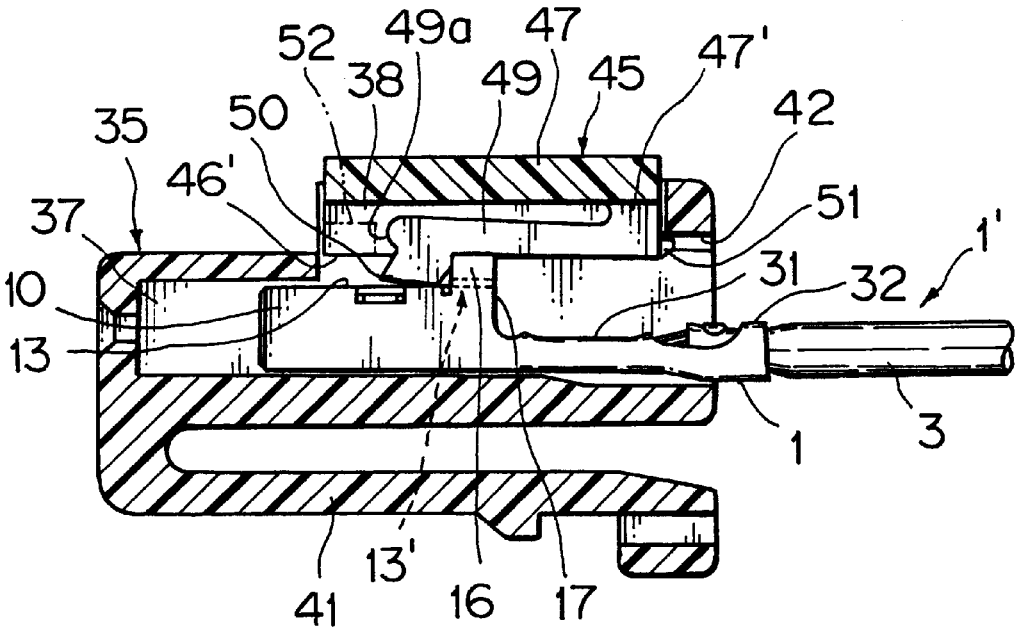
FIG. 5 is a sectional view showing the terminal of FIG. 1 attached with an electric wire being inserted into the connector housing, with the terminal locking device mounted in a preliminary locked position on the connector housing.

As shown in FIG. 5, the terminal locking device 45 is inserted from the locking device mount opening 38 of the connector housing 35 until its locking projection 51 engages with the ceiling wall 42 at the rear end inside the connector housing 35, at which time the terminal locking device 45 is mounted in a preliminary locked position on the connector housing 35.

The terminal 1 with the wire 3 attached thereto by means of the holding means 31, 32 is then inserted through an inlet opening 37*a* into the terminal receiving cavity 37 of the connector housing 35, during which the stabilizer 16 slides at its upper end surface along the lower end surface 46' of the side wall 46 of the terminal locking device 45, and the locking claw 50 of the resilient locking arm 49 slides successively on the ceiling wall 13 and the double ceiling wall 13' (FIG. 1) of the electric contact section 10 of the terminal 1. In this instance, the resilient locking arm 49 does not contact the stabilizer 16, the latter being located sideways relative to the former. The terminal 1 is further advanced until it is located in a fully-inserted position in the terminal receiving cavity 37.

Figure 6:
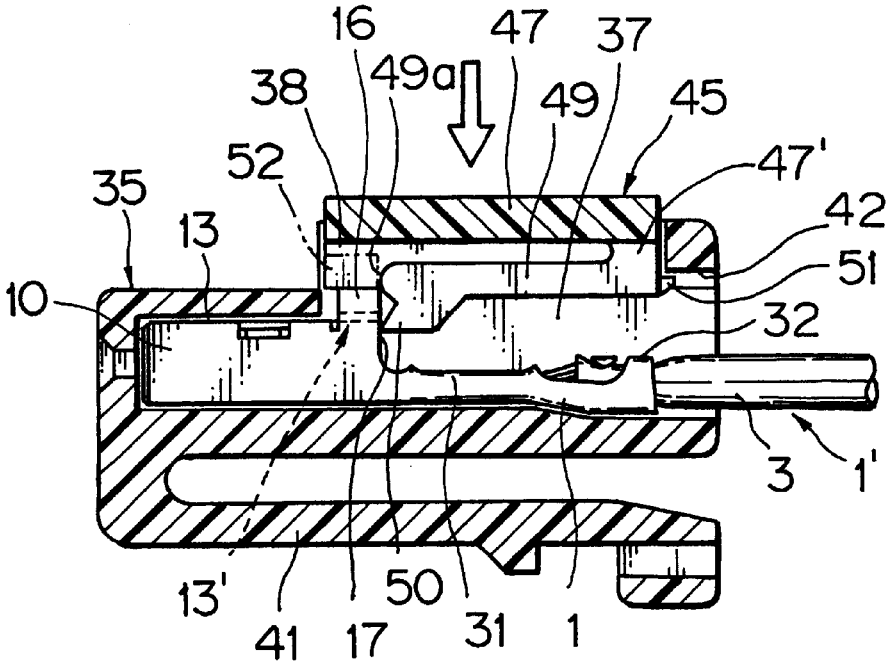
FIG. 6 is a sectional view similar to FIG. 5, showing the terminal locking device about to be pushed into a full locked position on the connector housing.
Figure 7:
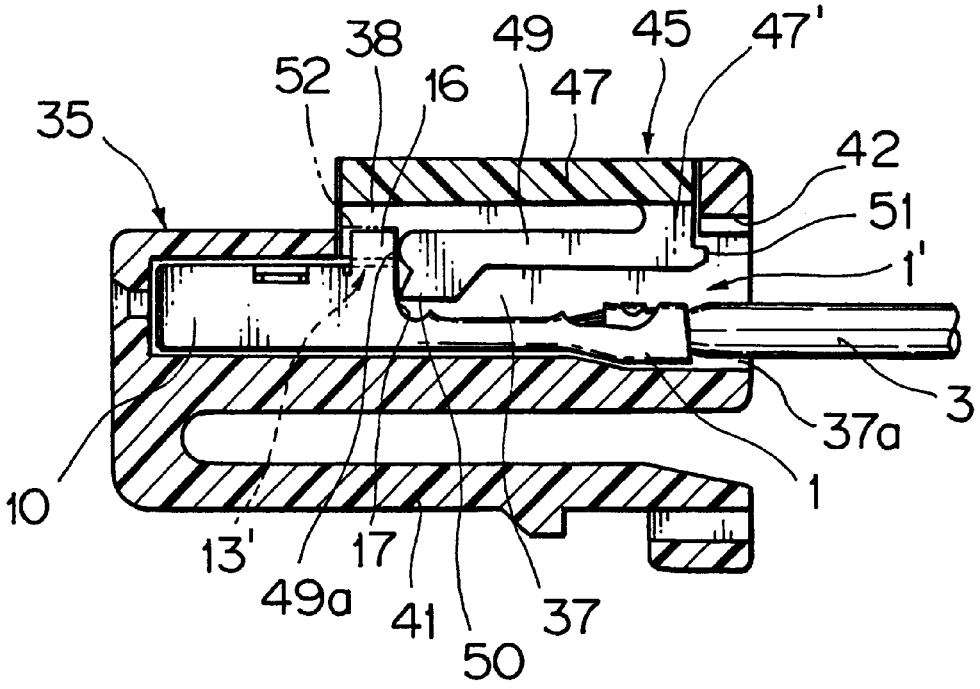
FIG. 7 is a sectional view similar to FIG. 5, showing the wire-attached terminal fully inserted into the connector housing and the terminal locking device mounted in the full locked position on the connector housing.

If the terminal 1 is fully inserted, as shown in FIG. 6, the locking claw 50 engages with an upper portion of a shoulder 17 formed at the rear end surface of the double ceiling wall 13' of the contact section 10 to retain the terminal in a first locked position. The terminal locking device 45 is then shoved in the arrow-indicated direction into the locking device mount opening 38 until its locking projections 48 (FIG. 4) engage in the locking grooves 40 of the connector housing 35 so as to mount the terminal locking device 45 in a full locked position on the connector housing 35 as shown in FIG. 7. Consequently, the stabilizer 16 engages in the cutout 52 of the side wall 46, while the shoulder 17 of the double ceiling wall 13' is maintained engaged by the locking claw 50 so as to double lock the terminal 1 in place in the terminal receiving cavity 37 in this secondary locked position of the terminal.

If the terminal locking device 45 is shoved in the arrow-indicated direction (FIG. 6) into the locking device mount opening 38 with the terminal 1 inserted incomplete as shown for example in FIG. 5, the side wall 46 abuts, at its lower end surface 46', against the upper end surface of the stabilizer 16 and is prevented from further advancement into the locking device mount opening 38. The stabilizer 16 thus does not engage in the cutout 52 and the shoulder 17 of the double ceiling wall 13' does not come into engagement with the locking claw 50 of the resilient locking arm 49, either. Incomplete insertion of the terminal 1 is thus detected by whether or not the terminal locking device 45 can be moved to a full locked position on the connector housing 35.

Thus, with the construction as described above, because the detection of the position of the inserted terminal 1 in the terminal-receiving cavity 37 is effected by the two-step process of first engaging the shoulder 17 with the locking claw 50 of the resilient locking arm 49 and then engaging the stabilizer 16 in the cutout 52 of the side wall 46, a greatly improved reliability can be obtained as compared with the mentioned prior art.

Further, because of the reinforcement plate 15 which extends from the end of the stabilizer-constituting extension plate 14 to be laid on the ceiling wall 13 (FIGS. 2 and 3), the stabilizer 16 itself is reinforced, with the result that a pressing force F (FIG. 1) exerted by the side wall 46 on the stabilizer 16 in case of an incomplete insertion of the terminal 1 does not cause bending or deformation of the stabilizer, thereby maintaining an accurate detectability of the position of the inserted terminal 1.

Further, because, unlike the prior art, the terminal 1 is double-locked in the terminal-receiving cavity 37 by the engagement of the shoulder 17 and the locking claw 50 and the engagement of the stabilizer 16 and the cutout 52 of the terminal locking device 45 as described above and as shown in FIG. 7, the force with which the terminal 1 is locked is made stronger. Due to this, the terminal 1 stably held inside the terminal receiving cavity 37, leading to a reliability of the product.

Figure 8:
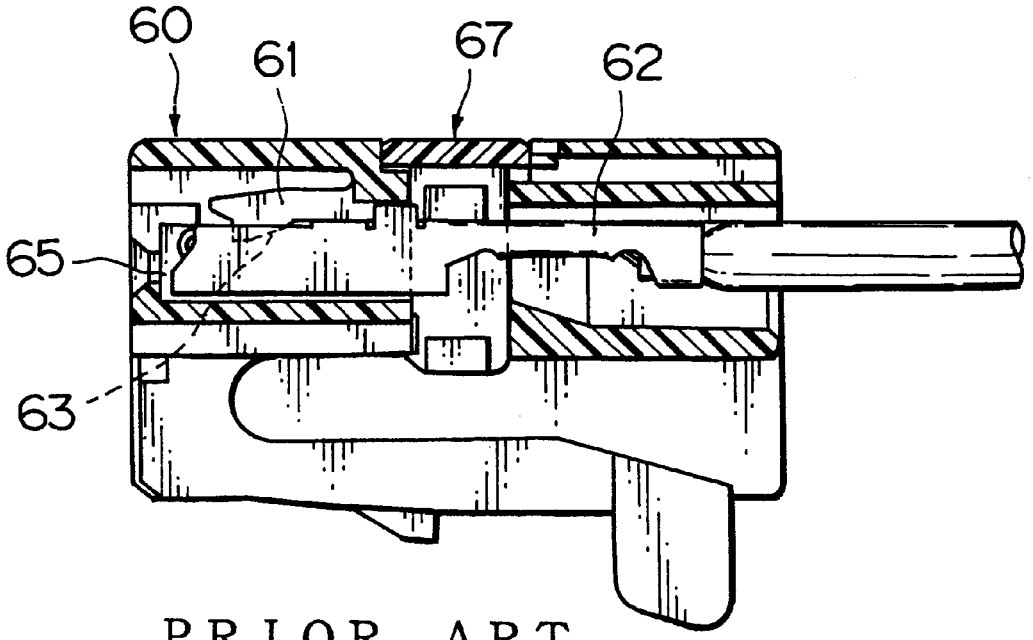
PRIOR ART FIG. 8
FIG. 8 is a sectional view of a conventional example.
Figure 9:
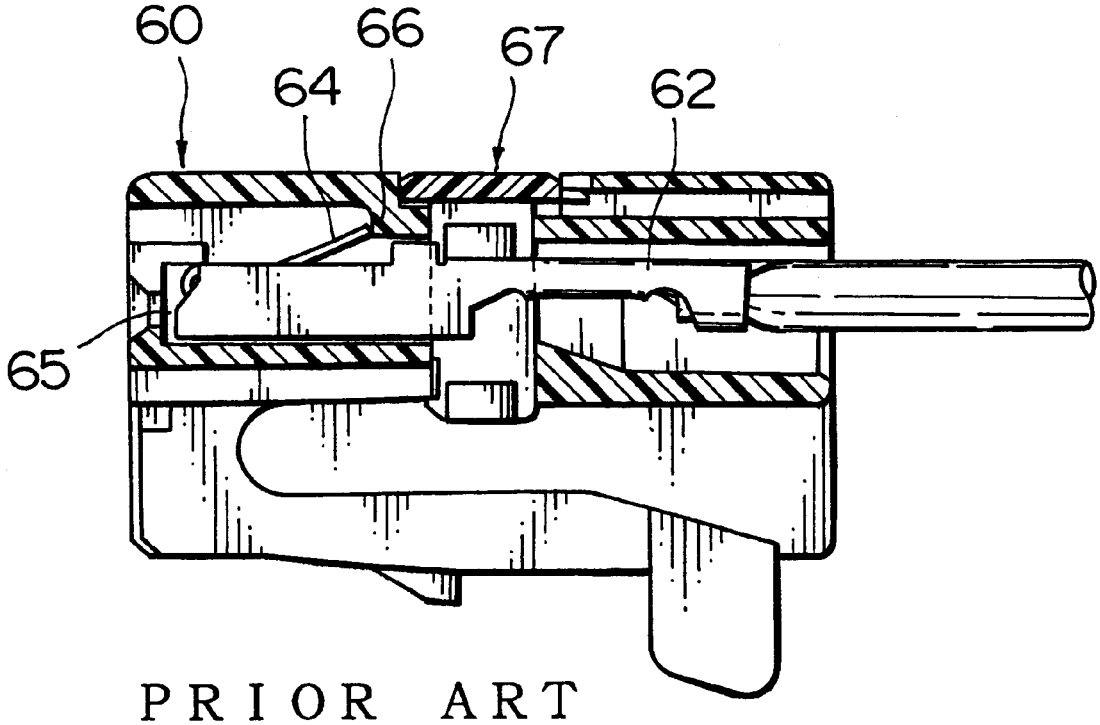
PRIOR ART FIG. 9
FIG. 9 is a sectional view of another conventional example.

Further, because, unlike the prior art, there is no need to provide the locking lance 61 inside the terminal receiving cavity 65 (FIG. 8), or there is no need to form the terminal 62 with the locking piece 64 (FIG. 9), it is possible to downsize the connector housing 35.

Having now fully described the invention, it will be apparent to one of ordinary skill in the art that many changes and modifications can be made thereto without departing from the spirit and scope of the invention as set forth herein.

What is claimed is:

1. In combination, an electric terminal with an electric contact portion, said contact portion having a hollow square shape and comprising a ceiling wall with a shoulder formed at an end thereof on a side opposite a side where a mating terminal is fitted, a side wall, and a stabilizer, said stabilizer including an extension plate extending in a height direction from said side wall and bent back on a side of said ceiling wall to provide a double layered plate;

a connector housing with a terminal receiving cavity formed therein; and a terminal locking device mountable in a preliminary locked and full locked positions on said connector housing, said terminal locking device including a resilient locking arm and a side wall, said side wall having a cutout corresponding to said stabilizer of said electric terminal, wherein when said terminal locking device is mounted in said preliminary locked position on said connector housing, said electric terminal is insertable into said terminal receiving cavity to have said shoulder engaged by said resilient locking arm, and when said terminal locking device is moved from said preliminary locked position to said full locked position on said connector housing, said stabilizer, while maintaining said shoulder engaged by said resilient locking arm, engages in said cutout, and wherein said terminal locking device is movable from said preliminary locked position to said full locked position only when said electric terminal has been fully inserted into said terminal receiving cavity, wherein said stabilizer further comprises a reinforcement plate extending from an end of said bent back extension plate and located on said ceiling wall of said contact portion.

2. The combination according to claim 1, wherein said stabilizer is located at an end of said side wall on said side opposite the side where said mating terminal is fitted, and said reinforcement plate is located on said end of said ceiling wall.

3. An electric terminal with an electric contact portion, said contact portion having a hollow square shape and comprising:

a ceiling wall with a shoulder formed at an end thereof on a side opposite a side where a mating terminal is fitted;

a side wall; and a stabilizer, said stabilizer including an extension plate extending in a height direction from said side wall and bent back on a side of said ceiling wall to provide a double layered plate, wherein said stabilizer further comprises a reinforcement plate extending from an end of said bent back extension plate and located on said ceiling wall of said contact portion.

4. The electric terminal according to claim 3, wherein said stabilizer is located at an end of said side wall on said side opposite the side where said mating terminal is fitted, and said reinforcement plate is located on said end of said ceiling wall.

* * * * *